US005329651A

United States Patent [19]

Mardero et al.

[11] Patent Number: 5,329,651

[45] Date of Patent: Jul. 19, 1994

[54] BATHING APPARATUS FOR THE INFIRM

[75] Inventors: Steve G. Mardero; Brian D. Prystupa, both of Manitoba, Canada

[73] Assignee: Fiat Products Ltd., Winnipeg, Canada

[21] Appl. No.: 51,244

[22] Filed: Apr. 23, 1993

[51] Int. Cl.[5] ..... A47K 3/022

[52] U.S. Cl. ..... 4/605; 4/561.1; 4/562.1; 4/567; 4/568; 4/571.1; 4/615; 4/611

[58] Field of Search ..... 4/903, 605, 596, 578.1, 4/571.1, 573.1, 591, 552, 561.1, 562.1, 564.1, 567, 568, 569, 570, 576.1, 604, 611, 615, 605, 254; 135/82, 84, 68, 65, 67; 128/845

[56] References Cited

U.S. PATENT DOCUMENTS

| | | | |
|---|---|---|---|
| 2,017,396 | 10/1935 | Brown | 4/615 |
| 2,582,586 | 1/1952 | Dorr | 4/562.1 |
| 2,678,083 | 5/1954 | Dall et al. | 4/578.1 |
| 2,680,855 | 6/1954 | Robinson | 4/562.1 |
| 2,817,095 | 12/1957 | Jeffries | 4/576.1 |
| 3,568,220 | 3/1971 | Dees | 4/576.1 |
| 3,662,406 | 5/1972 | Giglio | 4/541.6 |
| 3,669,362 | 6/1972 | Meyerhofer et al. | 4/570 |
| 3,924,808 | 12/1975 | Cooley, Jr. | 4/605 |
| 4,569,091 | 2/1986 | Brandenberger | 4/562.1 |
| 4,624,019 | 11/1986 | Pennington-Richards | 4/566.1 |
| 4,809,369 | 3/1989 | Bowden | 4/615 |
| 4,975,993 | 12/1990 | Black et al. | 4/615 |

FOREIGN PATENT DOCUMENTS

| | | | |
|---|---|---|---|
| 1805421 | 5/1970 | Fed. Rep. of Germany | 4/576.1 |
| 409804 | 10/1966 | Switzerland | 4/570 |
| 2248547 | 4/1992 | United Kingdom | 4/562.1 |

*Primary Examiner*—Henry J. Recla
*Assistant Examiner*—Gregory Vidovich
*Attorney, Agent, or Firm*—Adrian D. Battison; Stanley G. Ade; Murray E. Thrift

[57] ABSTRACT

A bathing apparatus is designed specifically for aged or infirm bathers to improve their independence. A conventional tub and shower enclosure is modified by a modular system including a pivotal support bar member which can move to a position projecting outwardly from the rear wall of the shower enclosure to enable the bather to stand at the bath. The bar member includes a lower horizontal bar against which the stomach of the bather rests and an upper bar spaced away from the stomach which can be grasped by the hands of the bather. A swivelling showerhead is mounted on the rear wall and includes a handle allowing a flooding type shower head to be moved back and forth over the head of the bather. A transfer chair can be provided which is mounted on a vertical post at one corner of the bathtub and includes an arm projecting horizontally outwardly from the post which can swivel around the post. A chair is canti levered downwardly and forwardly from the arm and swivels on the arm. A jack alongside the post moves the chair upwardly and downwardly and it can swivel freewardly about the post from a position wholly outside the bathtub to a position wholly within the bathtub.

25 Claims, 4 Drawing Sheets

BATHING APPARATUS FOR THE INFIRM

The present invention relates to a bathing apparatus particularly designed for the senior citizen or infirm person which is designed with elements to assist that person in bathing themselves.

Bathing is a very important part of life and it is especially important for the dignity of the individual that, where possible, this can be done privately without the need for assistance. In addition where assistance is required and offered, there is great difficulty in providing that assistance to enable the bather to enter a bathtub for bathing due to the structure of a bathtub which requires the caregiver to lean over the front wall of the bathtub while assisting the weight of the bather entering the bathtub. From both of these points of view, therefore, there is a very great need for bathing apparatus which is designed particularly for the elderly or infirm.

Previous proposals have been made for chair lifts which operate to raise and lower the bather into the bathtub. In most cases these arrangements comprise a chair structure which is mounted wholly within the bathtub and is raised and lowered from that position within the bathtub from a height above the front wall of the bathtub downwardly into the tub to immerse the bather. The arrangements positioned wholly within the bathtub are in some cases difficult to enter during the transfer process. In addition such a device prevents the bathtub from being used in a conventional manner by able bodied bathers.

Many persons have sufficient ambulatory capacity to enable them to use a bathtub and shower arrangement without the necessity for a transfer chair. In some cases such persons do however have balance or strength problems that require them to have some assistance in the bathtub or shower enclosure from support bars and the proper location of the shower heads.

One example of a transfer chair arrangement is shown in a brochure entitled the "Dignity Bath" from Electric Mobility of Sewell, N.J. Another example is shown in a brochure entitled the "Comfort Care System" by Ferno-Washington Inc. of Willmington, Ohio. These arrangements go some way to provide assistance to the bather but neither fully resolves the problems to provide the required level of assistance to different levels of infirmity with the possibility of increasing the level of assistance as infirmity increases.

It is one object of the present invention, therefore, to provide an improved bathing apparatus for the infirm.

According to the invention, therefore, there is provided a bathing apparatus comprising a bathtub having a bottom wall on which a bather can stand, a front wall, end walls, and a rear wall, each of the walls being generally upstanding from the bottom wall, a shower enclosure wall upstanding from the rear wall and a bather support bar member mounted on the shower enclosure wall and extending therefrom horizontally and substantially at right angles to the shower enclosure wall at a height approximating to the stomach area of the bather.

According to a second aspect of the invention there is provided a bathing apparatus comprising a bathtub having a bottom wall on which a bather can stand, a front wall, end walls, and a rear wall, each of the walls being generally upstanding from the bottom wall, a shower enclosure wall upstanding from the rear wall and comprising a swivel member mounted on the shower enclosure wall and defining a swivel axis at right angles to the shower enclosure wall, a shower mast mounted on the swivel member for pivotal movement about the swivel axis, the mast having a first portion extending substantially in the vertical plane parallel to the shower enclosure wall and a second portion substantially at right angles to the plane so as to extend outwardly from the shower enclosure wall over the bather, a shower nozzle carried on the second portion for spraying onto the bather and a handle portion graspable by the bather for effecting said pivotal movement such that the shower nozzle moves in an arc from a position forwardly of bather over the bather to a position rearwardly of the bather.

According to a third aspect of the invention there is provided a bathing apparatus comprising a bathtub having a bottom wall on which a bather can stand, a front wall, end walls, and a rear wall, each of the walls being generally upstanding from the bottom wall, a shower enclosure wall upstanding from the rear wall and a transfer chair for transferring an infirm person from a position outside the front wall into the tub for bathing, the transfer chair comprising a vertical support post, sleeve means slideable along the post and rotatable about a longitudinal axis of the post, means mounting the post at one corner of the bathtub at a junction between the front wall and one end wall and standing upwardly therefrom, lift means for raising and lowering the sleeve means on the post, a support arm projecting horizontally from the sleeve means so as to be rotatable with the sleeve means from a bathing position parallel to said one end wall to a transfer position parallel to the front wall and a seat portion suspended downwardly and forwardly from the arm.

One embodiment of the invention will now be described in conjunction with the accompanying drawings in which

DETAILED DESCRIPTION

Figure 1:
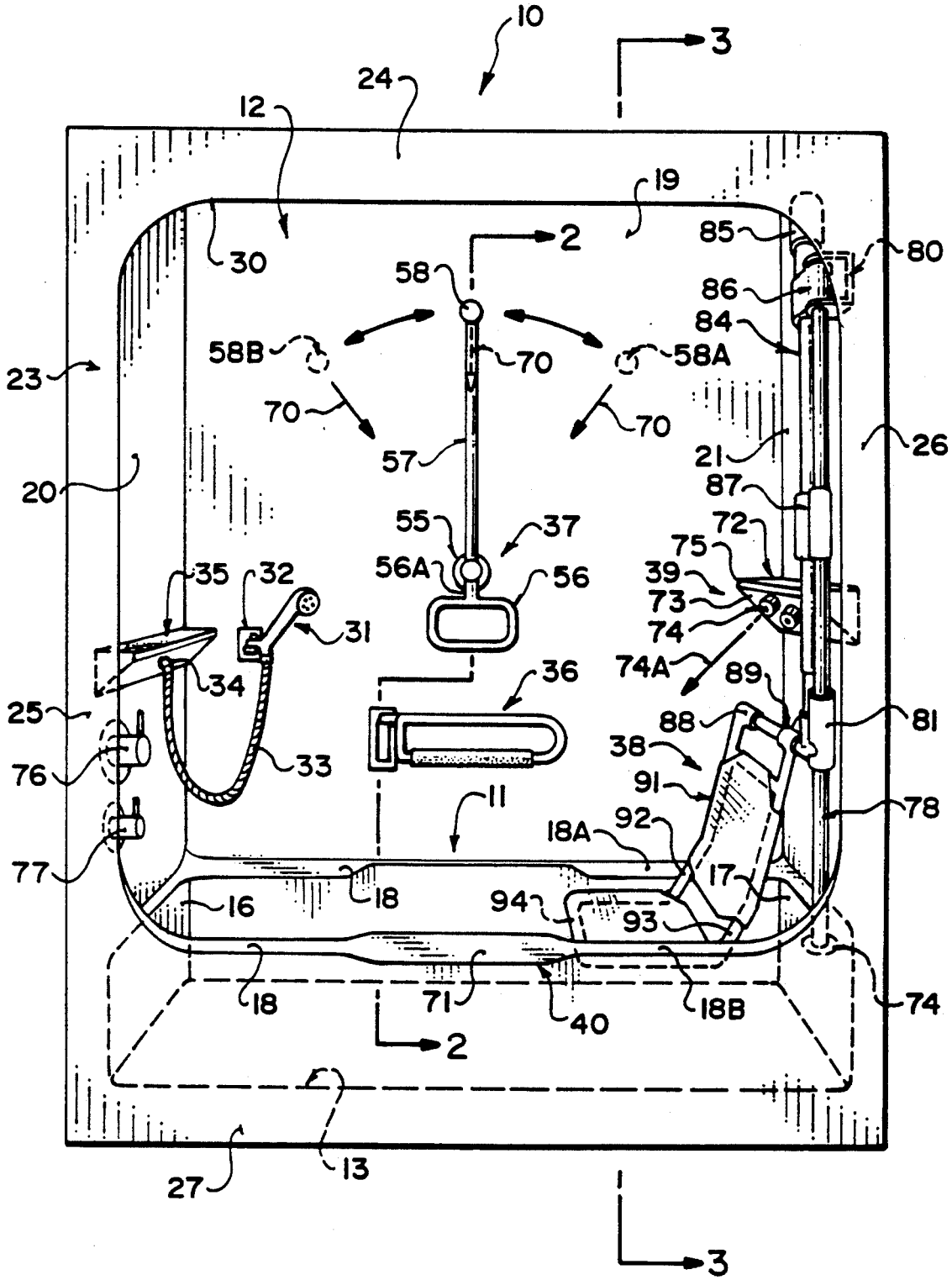
FIG. 1 is a perspective view of the bathing apparatus according to the invention from the front.

The bathing apparatus of the present invention comprises a tub and shower surround assembly generally indicated at 10 which is of a generally conventional nature formed as an integral structure to define a tub section 11 and a shower enclosure section 12.

Tub and shower enclosures of this type are well known and are conventionally manufactured by vacuum forming a sheet of acrylic or similar material which is then reinforced on its outer surface by generally a fiberglass layer and by reinforcing elements often from wood at suitable structural points.

The tub section 11 includes a bottom wall 13, a rear wall 14, a front wall 15, a first end wall 16 and a second end wall 17. The upper edges of the walls terminate at a top surface of the tub section which generally surrounds the full periphery of the tub section as indicated at 18. The top surface 18 extends around the full periphery of the tub section but varies in width as described in more detail hereinafter.

Above the tub section is provided the shower enclosure section which similarly includes a rear wall 19 and two end walls 20 and 21. The front wall of the shower surround section is open to allow access into the interior of the tub and the shower surround. A surrounding flange portion 23 includes a top flange portion 24, two side flange portions 25 and 26 and a bottom flange portion 27. The shower surround further includes a top wall 28. The end walls 20 and 21 of the shower enclosure and the top wall 28 all terminate at the front edge in inwardly turned rib portion 30 with the material of the vacuum formed part then turning outwardly to from the flange 24, 25, 26 or 27 respectively.

The above described arrangement is of a conventional nature and the techniques for manufacture of the tub shower enclosure assembly form an integral structure are well known.

The conventional plumbing for filling the bathtub and for emptying the bathtub is not shown as this is well known to one skilled in the art. The walls of the integral tub and shower enclosure are shown only as a single thickness but it will be appreciated that the wall can be formed using acrylic sheet and additional reinforcing material as is well known in the art. A conventional hand held shower is indicated at 31 mounted on a suitable support 32 attached to the rear shower enclosure wall 19. A flexible hose 33 that is connected to a suitable outlet 34 for communicating water to the hand held shower nozzle. In the embodiment shown the outlet for the flexible hose is positioned on the under side of a shelf structure 35 formed as an indentation in the end wall 20.

The above described arrangement of a tub and shower enclosure is entirely conventional and the modifications as related to the embodiment of the present invention are described hereinafter.

The enclosure is firstly modified by the addition of a bather support member generally indicated at 36. The enclosure is further modified by the addition of a pivotal shower nozzle generally indicated at 37. A yet further modification involves the addition of a transfer chair arrangement generally indicated at 38. A yet further modification includes the addition of massaging nozzles positioned at a particular location as described hereinafter and indicated at 39. A yet further modification involves the change in the design of the ledge 18 at the front portion thereof to provide a horizontal seat pad as indicated at 40.

Figure 2:
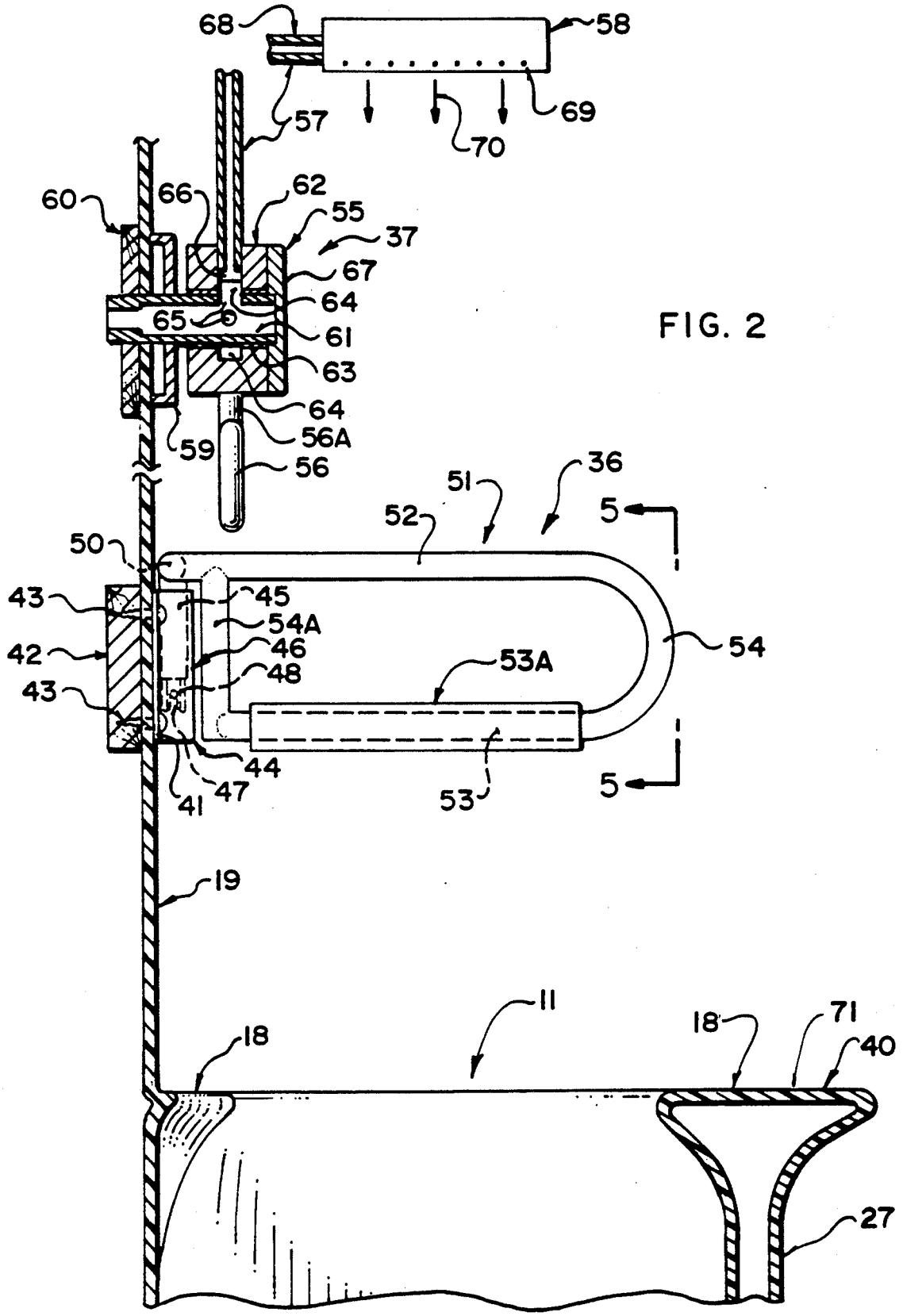
FIG. 2 is a view along the lines 2—2 of FIG. 1.
Figure 5:
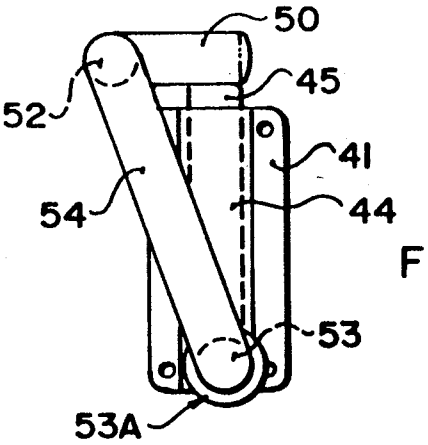
FIG. 5 is a view along the lines 5—5 of FIG. 2.

The support bar member is shown in more detail in FIGS. 2 and 5 and comprises a support bracket 41 mounted on the rear shower enclosure walls 19. A raised pad or rib (not shown) may be provided on the rear wall 19 at a suitable location to define the point of attachment of the support bar member. A reinforcing element 42 of wood or other suitable material is attached to the rear surface of the wall 19 to provide structural support. Alternatively, the rear wall 19 may be placed against the stud of the building within which the bathing apparatus is installed and the bracket 41 directly attached to the stud by screws 43.

The bracket 41 comprises a flat plate lying against the rear wall 19 and a sleeve 44 carried on the front surface of the plate and defining a vertical cylindrical bore for receiving a post 45 of the support bar itself. The post 45 carries a sleeve bearing allowing vertical sliding movement of the post within the cylindrical ball of the sleeve provided the vertical force is applied at or closely adjacent the post. A twisting force on the post caused by vertical force from a position on the bar spaced away from the post causes binding and prevents the sliding movement.

At the lower end of the post 45 is provided a locking member 46 having a pair of transverse slots 47 for receiving a horizontal pin 48 extending across the ball of the sleeve 44. As the slots 47 are arranged at right angles, the pin locates the post 45 at 90° spacing around the axis of the sleeve 44. Thus, as shown in FIG. 1, the bar may be located lying parallel to the rear wall 19 that is effectively along the inside surface of the rear wall in a stored or retracted position. In the position shown, the bar extends to the right but it will be appreciated that the bar can be rotated through 90° by lifting the post to remove the slot 47 from the pin 48 thus allowing rotation to 90° whereupon the post can slide downwardly to re-engage the slot on the pin. Thus the post can be moved downwardly within the sleeve to a position shown in FIG. 2 in which the bar projects outwardly from the rear wall 19 generally at right angles thereto and transversely to the length of the bathtub. The bar structure itself is mounted on the post 45 and includes a first portion 50 at right angles to the post. In the position shown in FIG. 2, the horizontal portion 50 lies parallel to the rear wall 19. Canti-levered from the outer end of the portion 50 is the bar structure in the form of a loop 51 having a top horizontal bar 52, a bottom horizontal bar 53, a curved outer connecting portion 54 and a straight inner connecting portion 54A. The loop lies in a common plane which is inclined to the vertical post 45 so that the top bar 52 is positioned as shown in FIG. 5 in a vertical plan spaced toward one end of the bathtub. The bottom bar 53 lies in a common plane with the post 45. The bottom bar 53 carries a covering layer 53A of a closed cell foam material. This forms a sleeve along substantially the whole of the bar 53 and provides a soft material against which the body of the bather can press if required to restore balance. This avoids the body contacting a cold metal or hard material and renders the bar more comfortable to the touch.

The height of the bar member 36 is arranged so that the bottom bar 53 is positioned at approximately the area of the stomach of a bather when standing on the bottom surface 13 of the tub. A bather standing at a tub experiencing balance difficulties or some weakness can therefore place the stomach area of the bather against the bar 53 to provide some stability and some support. With the stomach of the bather pressed against the bar 53, the bar 52 is held away from the stomach of the bather by the configuration shown in FIG. 5 so that the bar 52 is available for the hands of the bather to reach down and rapidly grasp the bar in the event of a temporary balance problem.

The shower nozzle arrangement 37 is shown particularly in FIGS. 1 and 2 and comprises a swivel mounting 55, a handle 56, a shower mast 57 and a shower nozzle 58. The swivel coupling 55 is mounted on a support member 59 again connected to the wall 19 at a reinforcement element 60. The bracket 59 carries a hollow post 61 which is connected at its rear end to a suitable plumbing fitting providing a supply of water into the hollow interior of the post 61. A swivel member 62 is carried on the post 61 on sleeve bearings 63 allowing rotation of the swivel member 62 about the axis of the post. The swivel member 62 comprises a cylindrical body having an annular channel on the inside as indicated at 64 which communicates with a series of outlet ports 65 provided in the post 61. The swivel member 62 further includes a radial bore 66 which communicates with the hollow mast or pipe 57 so that water supplied into the interior of the post follows through the mast 57 regardless of the angle of the swivel member 62 about the fixed post. An end cap 67 holds the swivel member in position on the post and closes the end of the post. Alternatively in a retrofit arrangement, a front plumbing hose can connect to a nipple on the swivel member.

The mast 57 includes a vertical portion lying in a plane parallel to the wall 19 and a horizontal portion 68 extending at right angles from the outer end of the vertical portion. Upon the horizontal portion 68 is mounted the shower nozzle 58 in the form of a cylindrical body having a plurality of holes 69 on the face thereof extending along the direction of the mast 57 so as to spray water in the direction of the arrows 70. The holes 69 are at spaced positions along the length of the cylindrical nozzle so as to form the spray pattern into a curtain lying generally in the plane containing the vertical and horizontal portions of the mast.

The handle 56 is in the form of a loop lying in the vertical plane parallel to the wall 19 containing the mast 57. The loop includes a short stub portion 56A connected to the bottom of the swivel member 62 so that forward and rearward movement of the handle causes the spray nozzle 58 to move rearwardly and forwardly respectively to a rearward position 58A behind the bather while standing at the support bar and to a forward position 58B forwardly of the bather while standing at the bar. The position of the swivel member 55 relative to the bar is shown best in FIG. 1 where it will be noted that with a bather standing next to the bar with the stomach adjacent or pressed against the bar, the handle 56 is positioned just to the right hand so that the bather can readily grasp the bottom of the loop to operate the swivel and move the spray nozzle forwardly or rearwardly as required.

The bather is thus able to take a shower while stabilized by the presence of and engagement with the bar without the necessity of the bather moving within the tub to cause the water to spread over the body of the bather. The full area of the body of the bather can be sprayed by moving the nozzle rearwardly and forwardly with the nozzle having a relatively wide width to cover the full width of the body commencing forwardly and then passing over the head of the bather to the rear. The nozzle is arranged to have a flooding effect rather than a high velocity to provide a relatively large quantity of water over the bather without the danger of stinging the eyes of the bather.

In order to assist the bather in entering the tub to stand at the bar, the upper edge 18 at the front of the tub includes a widened portion 71 across a middle part of the top of the front wall as best shown in FIG. 1. The widened portion 71 thus forms a flat pad onto which a bather can place their bottom to transfer the legs one at a time over the top wall into the tub. While grasping the support bar 36, therefore, the bather who is able to stand but has some weakness or balance problems can enter the tub by sitting, by placing the legs while sitting over into the tub and then by standing using a pulling force on the support bar 36. When in position the support bar and the shower head cooperate in the manner described above.

A massage nozzle arrangement 39 is positioned on a shelf member 72 having a horizontal surface and a downwardly and rearwardly inclined undersurface 73. The massage nozzles are of a conventional construction indicated at 74 but are mounted on the inclined undersurface 73 at a position so that they are underneath and rearwardly of the front edge 75 of the horizontal surface. This ensures that the nozzles are maintained in a position underneath the protective structure of the shelf to prevent their impacting or damaging the bather should the bather lose balance and fall within the tub. The nozzle 74 are of a relatively short or stubby so that they are wholly contained underneath the shelf while projecting downwardly and outwardly at an angle of the order of 45°. The height of the nozzles is arranged such that, with the bather standing at the bar 36, the nozzles spray in a direction of an arrow 74A onto the rear lower part of the body of the bather. The nozzles are of a massaging type so that the hips and lower back of the bather can be massaged while the bather stands at the bar.

In an option (not shown) a seat structure of a conventional nature is positioned across the upper edge 18 of the tub from a rear portion 18A to a front portion 18B to allow the bather from a standing position at the bar 36 simply to sit down onto the seat at which time the nozzle 74 will direct the massaging stream onto the shoulders and upper part of the body of the bather.

The hand shower unit 31 is also accessible to the bather while standing at the bar 36. The bather can thus simply reach out to the bracket 32 and hold the hand shower 31 to provide specific showering effect as required.

Control of valves 76 and 77 of a conventional nature are mounted suitable on the wall of the shower enclosure. As shown they are mounted on the end wall 20 but in an alternative arrangement suitable in an initial installation, the control valves are mounted underneath the handle 56 on the rear wall 19. The valve 76 thus controls the rate and temperature of the flow. The valve 77 can be moved to select one, two or all of the three shower nozzles 31, 58 and 74 as required by the bather.

A bather having some ambulatory ability but difficulties with strength or balance can thus use the tub arrangement modified as described above but not including the transfer chair 38. The transfer chair can be provided in addition to the above modifications or as a separate element to be used in a conventional tub arrangement. In the event that the bather's ambulatory abilities decline over time, the transfer chair can be added as a later addition to the construction.

Figure 3:
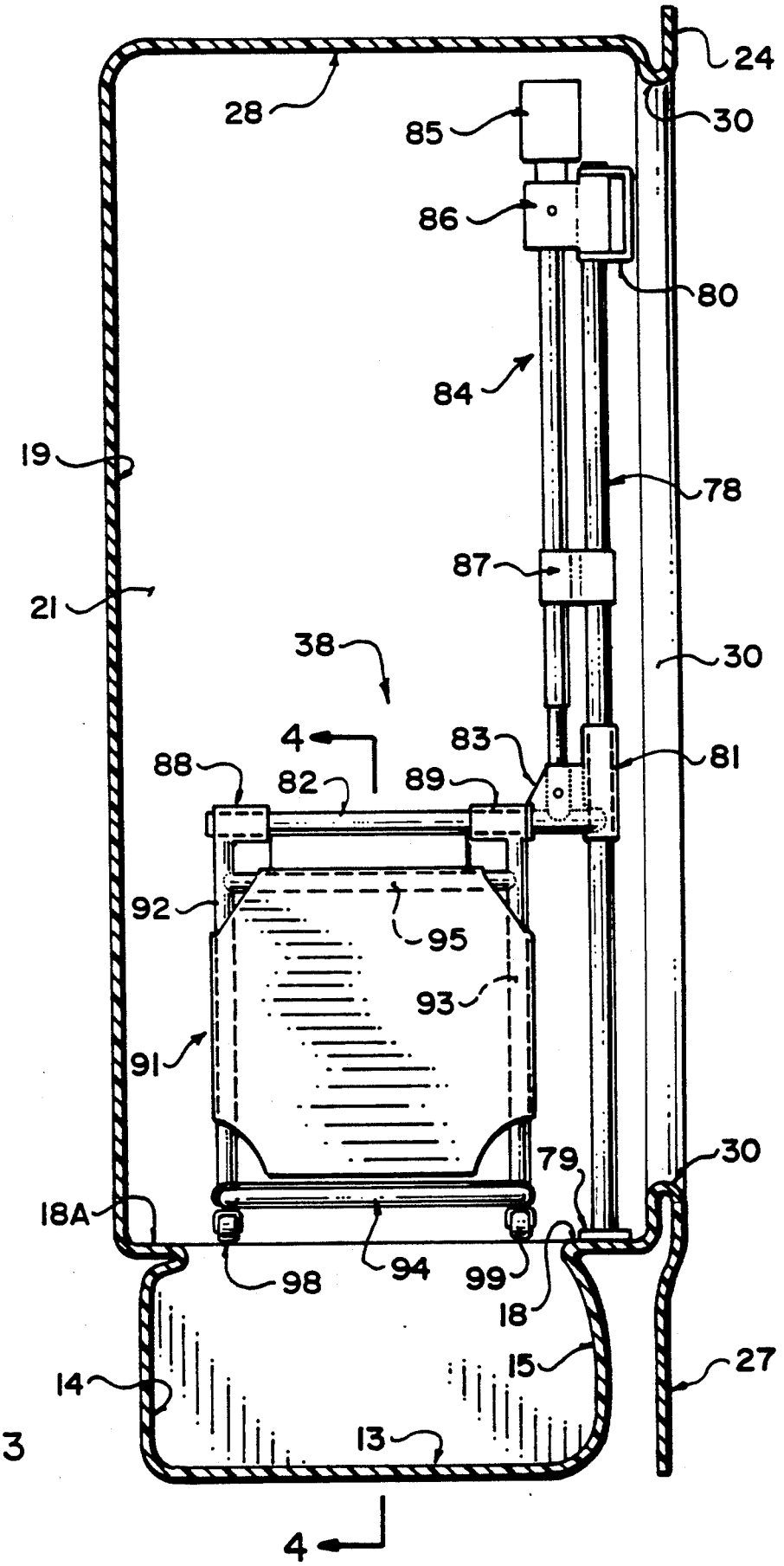
FIG. 3 is a view along the lines 3—3 of FIG. 1.
Figure 4:
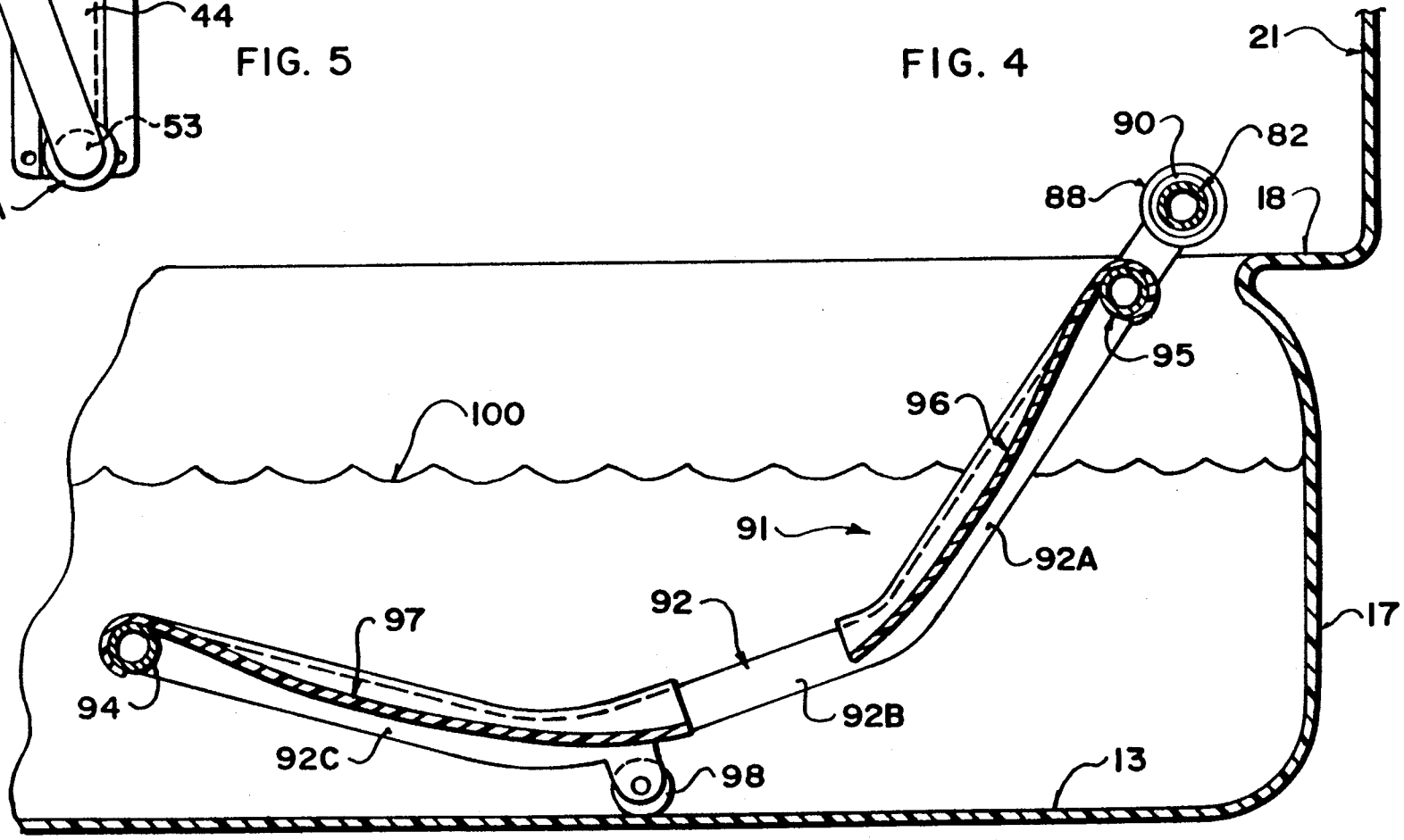
FIG. 4 is a view along the lines 4—4 of FIG. 3 showing the transfer chair in a lowered position.

The transfer chair is shown in FIGS. 1, 3 and 4. The transfer chair assembly comprises a main vertical support post 78 having a lower horizontal bracket 79 mounted on the top edge 18 of the tub at one corner of the tub. Thus the horizontal plate bracket 79 is positioned at the junction between the top of the front wall and the top of the end wall of the tub. As shown in FIG. 1, the plate 79 is concealed behind the front flange or edge 30. A top end of the post 78 is carried in a fixed clevis 80 attached to the end wall 21. The weight of the post and the elements carried thereby is thus transferred vertically downwardly onto the tub surface 18 at the corner which is structurally rigid and of sufficient strength to carry the weights involved up to for example the order of 250 pounds including the chair and the bather. The top bracket 80 can be of any suitable design sufficient to transfer the twisting loads on the post to the shower enclosure or to the structural members behind the shower enclosure as required.

Upon the post is mounted a sleeve 81 which can slide longitudinally of the post and also rotate about the longitudinal axis of the post. The sleeve carries a cylindrical bearing on the inside surface for engagement of the post. At the bottom end of the sleeve is mounted a horizontal arm 82 which projects outwardly from the sleeve at right angles thereto with structural support for the arm being provided by a gusset 83. The arm is then canterlevered from the sleeve so the arm can be moved vertically with the sleeve and also can rotate in a horizontal plane around the axis of the post 78.

Vertical movement of the sleeve and arm is effected by a jack 84 including a motor 85. The jack is carried upon a pair of collars 86 and 87 mounted on the post. The collar 86 is attached at the clevis 80 and the collar 87 at a lower position above the sleeve 81. The jack and the arm thus rotate together about the axis of the post.

The arm 82 comprises a cylindrical tube as best shown in FIG. 4 and itself carries a pair of collars 88 and 89 at opposed ends of the tubular arm 82. Each collar has a cylindrical bearing 90 surrounding the tubular arm to allow ready rotation of the collar about the tubular arm. A seat portion 91 is suspended from the collars 88 and 89 and includes two side frame tubes 92 and 93 each attached to a respective one of the collars. Each frame tube 92, 93 includes a first portion 92A extending downwardly and forwardly as best shown in FIG. 1, a second portion 92B inclined slightly forwardly from the first portion and a third portion 92C extending horizontally in a sitting position shown in FIG. 1. The tubes are interconnected at a front end by a transverse tube 94 and at a position closely adjacent the arm 82 by a transfer tube 95. The seat further includes molded plastics cover elements 96 and 97 which are attached to the side tubes and to the upper and lower tubes respectively to form a seat back and seat bottom respectively. In an alternative arrangement (not shown) the seat structure can be formed from molded plastics material as an integeral element thus avoiding necessity for some of the structural tubes supporting the seat.

The collars 88 and 89 are free to rotate about the arm 82 and in a clockwise direction but are halted against movement beyond the position shown in FIG. 1 in a counterclockwise direction by suitable stop elements (not shown). In the sitting position of the chair, therefore, it is suspended from the arm 82 in a position in which the seat back depends downwardly and forwardly in the inclined direction shown and then supports the seat bottom in a horizontal orientation. In this position, with the arm raised to a height at which the seat bottom is just above the edge 18, the arm can be rotated about the post to move the seat from a position inside the tub to a position wholly outside the tub. In a position outside the tub, the jack can be operated to lower the arm 82 and thus the seat downwardly so the seat bottom falls to a height below the edge 18. In this position rearward pressure on the seat causes the back of the seat to engage the outside wall or flange 27 of the tub. There is therefore no need for elements locking the seat in position outside the tub since the only forces on the seat are likely to be those of pressure as a non-ambulatory patient is lifted from a wheel chair or the like into the seat. The height of the seat can be adjusted down to floor level or just above floor level as required to a higher level which is most convenient for the patient to enter onto the seat. With the bather first located in the seat, the jack can be operated to raise the bather until the seat bottom is higher than the edge 18. At this height the chair can be rotated about the post simply by pressure by a care giver or by the bather by engaging the edge 18 or the bar as convenient.

When the chair is outside the tub, the triangular space underneath the arm 82 and behind the seat back allows the seat to be dropped outside of the front tub wall. In addition, in this position, the tub itself is entirely free from the chair structure and is possible for the bathing assembly to be used by another bather who does not require the transfer chair assembly. A shower curtain is free to be moved across the open face of the shower enclosure and to engage on the shower side of the post 78 so that the bather is then in no way inconvenienced by and cannot even see the transfer chair assembly.

When the transfer chair assembly is in the bathing position inside the tub as shown in FIG. 1, a shower curtain can be moved wholly outside the seat and post so that the shower curtain can wholly hide the transfer chair assembly.

When moved into the position shown in FIG. 1, the position of the arm 82 about the post is stabilized by the front and rear walls of the tub. As the jack is operated to lower the seat into the tub, a pair of wheels 98 and 99 mounted on the underside of the tubes 92 and 93 respectively engages the bottom wall 13 of the tub. The wheels are positioned on the portion 92B of the frame tube at the back of the portion 92C of the frame tube. The wheels project downwardly to a position such that the wheels firstly engage the tub before the portion 92C engages the tub. As the arm 82 continues to descend, the wheels allow the seat to move forwardly by rotating about the arm 82 so the patient gradually moves from an upright sitting position to a cupped lying position as shown in FIG. 4. This places the bottom of the bather within the water indicated at 100 with the leg slightly raised over the tube 94 and the head and back support out of the water, by the tube 95. The position of the bather in the water can thus be adjusted simply by raising and lowering the height of the arm 82.

Illumination for the shower enclosure can be provided by a pair of lights mounted in the rear enclosure wall at spaced positions on either side of the swivelling shower head and acts to illuminate the whole tub effectively to avoid danger to persons of reduced eyesight. The portion of increased width of the top edge 18 as indicated at 71 can be provided instead by a separate element which engages over a portion of the front wall. Such a separate element may be necessary to allow the conventional vacuum forming of the tub and shower surround as an integral signal element.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A bathing apparatus comprising a bathtub having a bottom wall on which a bather can stand, a front wall, end walls, and a rear wall, each of the walls being generally upstanding from the bottom wall, a shower enclosure wall upstanding from the rear wall and a bather support bar member mounted on the shower enclosure wall and extending therefrom horizontally and substantially at right angles to the shower enclosure wall at a height approximating to the stomach area of the bather, wherein the support bar member comprises a top bar and a bottom bar which lie parallel and vertically spaced, the bottom bar being arranged in a first vertical plane and the top bar being arranged in a second vertical plane spaced away from the first vertical plane such that with the bottom bar resting against the body of the bather, the top bar is held away from the body for engagement by the hands of the bather.

2. The apparatus according to claim 1 including means mounting the bather support bar member for pivotal movement about a vertical axis between a support position extending at right angles to the shower enclosure wall and a retracted position lying substantially parallel to the shower enclosure wall and means within said mounting means for locking the support bar member in each of said positions.

3. The apparatus according to claim 2 wherein the locking means comprises slide means allowing vertical movement of the support bar member from a lower locked position to a raised free position such that in the free position the support bar member can rotate freely about the vertical axis to move between said support and retracted positions, and at the lower position the support bar member is locked at one of said support and retracted positions, said slide means being arranged to allow vertical sliding movement only when the support 4. The apparatus according to claim 3 wherein the bottom bar includes a covering of a resilient material.

5. The apparatus according to claim 1 including a shower head for wetting the bather while standing at the support bar member, the shower head comprising a swivel member mounted on the shower enclosure wall and defining a horizontal swivel axis at a right angle to the shower enclosure wall, a rigid shower mast mounted on the swivel member for pivotal movement about the horizontal swivel axis, the mast having a first portion extending substantially in a vertical plane parallel to the shower enclosure wall and a second portion in connection with said first portion substantially at a right angle to the plane so as to extend away from the shower enclosure wall over the bather, a shower nozzle mounted on the second portion and arranged in fixed position relative thereto so as to direct water therefrom in a vertical plane parallel to the shower enclosure wall toward the horizontal swivel axis for spraying onto the bather and a handle portion rigidly coupled to the shower mast and graspable by the bather for effecting said pivotal movement such that the shower nozzle moves in an arc from a first position forwardly of the bather through a second position over the bather to a third position rearwardly of the bather, the shower nozzle being arranged such that the water therefrom is directed toward the horizontal axis in the first, second and third positions of the shower nozzle.

6. The apparatus according to claim 5 wherein the nozzle is cylindrical with a nozzle axis extending along the second portion and openings spaced along the nozzle axis.

7. The apparatus according to claim 4 wherein the handle portion is arranged on an opposite side of the swivel member relative to the shower mast.

8. The apparatus according to claim 6 wherein the handle portion comprises a loop portion lying in the plane of the first portion of the mast.

9. The apparatus according to claim 4 wherein the swivel member is arranged on the shower enclosure wall at a position rearwardly of and upwardly of the support bar member relative to a bather standing facing the support bar member.

10. The apparatus according to claim 1 including an end shower enclosure wall upstanding from one of said end walls and massage nozzle means positioned on said end shower enclosure wall.

11. The apparatus according to claim 9 wherein the end shower enclosure wall includes a projecting portion in connection therefrom having a horizontal upper shelf surface across the end wall and a downwardly, sloped undersurface extending from said upper shelf surface towards said end shower enclosure wall, the nozzle means being mounted on the undersurface of the projecting portion.

12. The apparatus according to claim 9 wherein the nozzle means is arranged to spray downwardly and away from the end shower enclosure wall to a position to contact the bather standing at the support bar member on a lower body portion of said bather and to a position such that when the bather is seated on a seat across the tub the bather is engaged by water from the nozzle means in an upper body area.

13. The apparatus according to claim 1 wherein the front wall includes an upper surface thereof of increased width at a centre part thereof defining a seat for the bather.

14. The apparatus according to claim 1 including a transfer chair for transferring an infirm person from a position outside the front wall into the tub for bathing, the transfer chair comprising a vertical support post, sleeve means slideable along the post and rotatable about a longitudinal axis of the post, means mounting the post at one corner of the bathtub at a junction between the front wall and one end wall and standing upwardly therefrom, lift means for raising and lowering the sleeve means on the post, a support arm projecting horizontally from the sleeve means so as to be rotatable with the sleeve means from a bathing position wherein said support arm is parallel to said one end wall to a transfer position wherein said support arm is parallel to the front wall, a seat portion suspended downwardly and forwardly from the arm, the seat portion being freely pivotal on the arm, a first seating position to a second seating position upwardly and forwardly of the first seating position and means on the seat portion for engaging the bottom wall of the bathtub such that the seat portion is pivoted upwardly and forwardly with respect to said support arm by engagement with the bottom wall as the arm is moved downwardly.

15. The apparatus according to claim 14 wherein the seat portion includes a seat back inclined forwardly and downwardly from the arm and a seat bottom extending forwardly from a lower end of the seat back, the seat bottom being cantilevered from the arm on the seat back.

16. The apparatus according to claim 13 wherein the lift means comprises a jack member extending along the post parallel to the post on the side of the post adjacent the arm.

17. The apparatus according to claim 13 wherein the post is mounted on a top surface of the corner of the bathtub so as to support weight from the post, the arm, and the seat portion downwardly thereon and wherein the arm and sleeve are freely pivotal about the post from a position in which the arm and seat portion lie wholly within the bathtub to a position in which the arm and seat portion lie wholly outside the bathtub.

18. A bathing apparatus comprising a bathtub having a bottom wall on which a bather can stand, a front wall, end walls, and a rear wall, each of the walls being generally upstanding from the bottom wall, a shower enclosure wall upstanding from the rear wall and a shower head comprising a fixed swivel member mounted on the shower enclosure wall and defining a horizontal swivel axis at right angles to the shower enclosure wall, a rigid, one-piece shower mast having one end mounted on the swivel member for pivotal movement about the horizontal swivel axis and on opposite end, the mast having a first portion and a second portion between said ends, said first portion extending substantially in a vertical plane parallel to the shower enclosure wall and said second portion substantially at right angles to the plane so as to extend outwardly from the shower enclosure wall over the bather, a shower nozzle mounted on the second portion proximate said opposite end and arranged in fixed position relative thereto so as to direct water therefrom in a vertical plane parallel to the shower enclosure wall toward the horizontal swivel axis for spraying onto the bather and a handle portion rigidly coupled to the shower mast and graspable by the bather for effecting said pivotal movement such that the shower nozzle moves in an arc from a first position forwardly of bather through a second position over the bather to a third position rearwardly of the bather, the shower nozzle being arranged such that the water therefrom is directed toward the horizontal axis in the first, second and third positions of the shower nozzle.

19. A bathing apparatus comprising a bathtub having a bottom wall on which a bather can stand, a front wall, end walls, and a rear wall, each of the walls being generally upstanding from the bottom wall, a shower enclosure wall upstanding from the rear wall and a transfer chair for transferring an infirm person from a position outside the front wall into the tub for bathing, the transfer chair comprising a vertical support post, sleeve means slideable along the post and rotatable about a longitudinal axis of the post, means mounting the post at one corner of the bathtub at a junction between the front wall and one end wall and standing upwardly therefrom, lift means for raising and lowering the sleeve means on the post, a support arm projecting horizontally from the sleeve means so as to be rotatable with the sleeve means from a bathing position wherein said support arm is parallel to said one end wall to a transfer position wherein said support arm is parallel to the front wall, a seat portion suspended downwardly and forwardly from the arm, the seat portion being freely pivotal on the arm from a first seating position to a second seating position upwardly and forwardly of the first seating position, and means on the seat portion for engaging the bottom wall of the bathtub such that the seat portion is pivoted upwardly and forwardly with respect to said support arm by engagement with the bottom wall as the arm is moved downwardly.

20. The apparatus according to claim 16 wherein the nozzle is cylindrical with a nozzle axis extending along the second portion and openings spaced along the nozzle axis.

21. The apparatus according to claim 16 wherein the handle portion is arranged on an opposite side of the swivel member relative to the shower mast.

22. The apparatus according to claim 19 wherein the handle portion comprises a loop portion lying in the plane of the first portion of the mast.

23. The apparatus according to claim 17 wherein the seat portion includes a seat back inclined forwardly and downwardly from the arm and a seat bottom extending forwardly from a lower end of the seat back, the seat bottom being cantilevered from the arm on the seat back.

24. The apparatus according to claim 17 wherein the lift means comprises a jack member extending along the post parallel to the post on the side of the post adjacent the arm.

25. The apparatus according to claim 17 wherein the post is mounted on a top surface of the corner of the bathtub so as to support weight from the post, the arm, and the seat portion downwardly thereon and wherein the arm and sleeve are freely pivotal about the post from a position in which the arm and seat portion lie wholly within the bathtub to a position in which the arm and seat portion lie wholly outside the bathtub.

* * * * *